United States Patent [19]

Stahlecker et al.

[11] Patent Number: 4,558,562

[45] Date of Patent: Dec. 17, 1985

[54] SPINNING AGGREGATE FOR WRAPPED YARN

[75] Inventors: Fritz Stahlecker, Josef-Neidhart Strasse 18, 7347 Bad Überkingen; Kurt Lang, Lauterstein, both of Fed. Rep. of Germany

[73] Assignees: Hans Stahlecker; Fritz Stahlecker, both of Fed. Rep. of Germany

[21] Appl. No.: 634,378

[22] Filed: Jul. 25, 1984

[30] Foreign Application Priority Data

Aug. 30, 1983 [DE] Fed. Rep. of Germany ..... 3331197

[51] Int. Cl.[4] ..... D02G 3/36; D02G 3/38

[52] U.S. Cl. ..... 57/18

[58] Field of Search ..... 57/6, 16–18, 57/73, 341–344, 351

[56] References Cited

U.S. PATENT DOCUMENTS

| | | | |
|---|---|---|---|
| 3,681,909 | 8/1972 | Korikovsky et al. | 57/18 X |
| 4,226,077 | 10/1980 | Hilbert | 57/18 |
| 4,299,083 | 11/1981 | Igel et al. | 57/18 |
| 4,336,683 | 6/1982 | Bock et al. | 57/18 |
| 4,348,858 | 9/1982 | Rottmayr | 57/18 |
| 4,391,089 | 7/1983 | Billner et al. | 57/18 X |
| 4,435,952 | 3/1984 | Stahlecker et al. | 57/18 |
| 4,472,931 | 9/1984 | Stahlecker | 57/18 |
| 4,481,760 | 11/1984 | Stahlecker | 57/18 |
| 4,484,433 | 11/1984 | Stahlecker et al. | 57/18 X |

*Primary Examiner*—Donald Watkins

*Attorney, Agent, or Firm*—Barnes & Thornburg

[57] ABSTRACT

A spinning aggregate is disclosed for spinning wrapped yarn. A drivable hollow spindle carrys a corotating sleeve with a binding yarn wound on said sleeve, a corotating positive false-twisting device into which the binding yarn and a sliver enter, said sliver being fed by means of a delivery mechanism having a pair of delivery rollers forming a nip, and a pair of withdrawal rollers following the hollow spindle. It is provided that the distance of the false-twisting device from the nip formed by the pair of delivery rollers of the delivery device is shorter than the median staple length of the sliver to be wound.

20 Claims, 3 Drawing Figures

Fig. 2
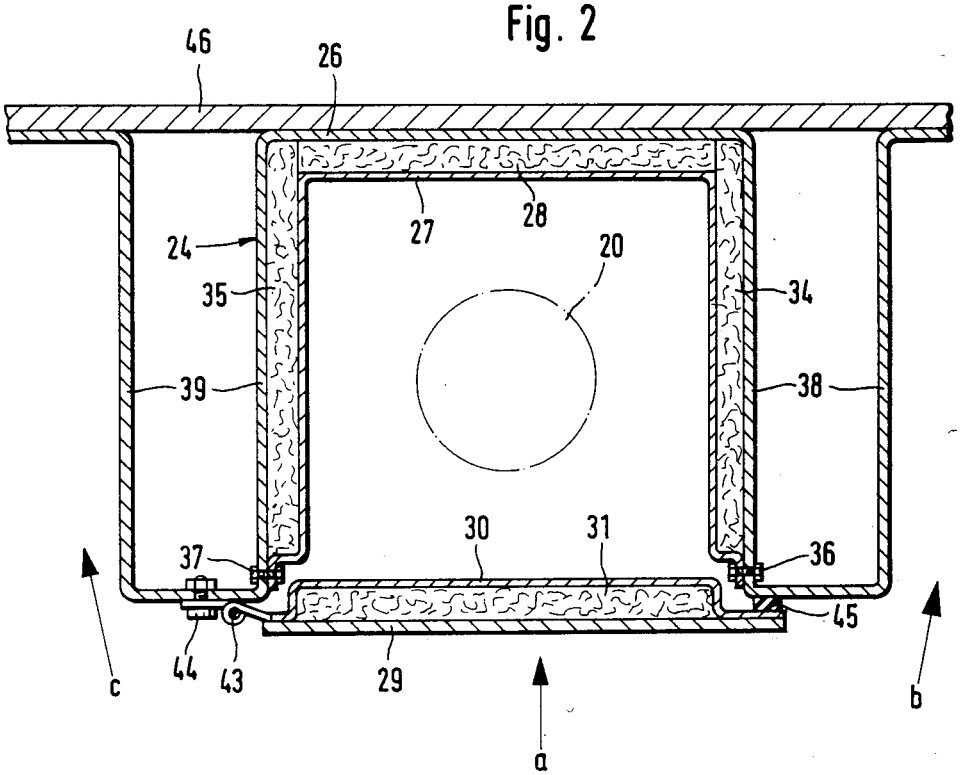
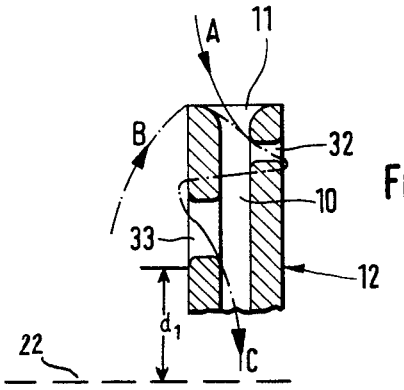
Fig. 3

SPINNING AGGREGATE FOR WRAPPED YARN

BACKGROUND AND SUMMARY OF THE INVENTION

This invention relates to a spinning aggregate for wrapped yarn having a drivable hollow spindle carrying a corotating sleeve with a binding yarn wound on said sleeve, a corotating positive false-twisting device into which the binding yarn and a sliver enter, said sliver being fed by means of a delivery device having a pair of delivery rollers forming a nip, and a pair of withdrawal rollers following the hollow spindle.

In the case of a known spinning aggregate for wrapped yarn of the initially mentioned type, disclosed in European Published Unexamined Patent Application (EP-OS) 67 701, an exactly defined false twist is produced by means of a positive false-twisting device, wherein the false-twisting device rotating along with the hollow spindle produces a false twist in the sliver between the false-twisting device and the delivery device during a rotation of the spindle. In order to produce a uniform wrapped yarn, it is provided in the case of the known construction that the false-twisting device is located preferably in the center between the nips of the pair of delivery rollers and the pair of withdrawal rollers, but not closer than one third of the total distance between the nips of both pairs of rollers in the direction of one of the two pairs of rollers. In practice, it has been found that despite the introduction of an exactly defined false twist and despite the maintaining of the prescribed distances, still relatively many irregularities exist in the spun yarn.

An object of the invention is to develop a spinning aggregate for wrapped yarn in such a way that the uniformity of the yarn is improved.

This object is achieved according to the invention by providing that the distance between the false-twisting device and the nip of the pair of delivery rollers is shorter than the means staple length of the sliver.

The present invention is based in part on the recognition that a false twist distance between the nip of the pair of delivery rollers and the false-twisting device that is too long results in irregularities, because the applied false twist distance is not distributed evenly over the sliver. There is the danger that thick and thin points existing in the sliver are false-twisted differently, namely that more of a false twist is introduced into the thin points than into the thick points. The thus reinforced thin and thick points will then be fixed by the binding yarn so that in the finished yarn, the previously existing slightly thick and thin points appear to an increased extent. By means of the substantial shortening of the false twist distance between the false-twisting device and the nip of the pair of delivery rollers according to the invention, an uneven introduction of the false twist is essentially prevented. In practice, it was found according to the invention that the resultant lengthening of the distance between the pair of withdrawal rollers and the false-twisting device results in no disadvantages since in this area the sliver is already fixed by the binding yarn and is furthermore untwisted.

In the case of a spinning aggregate for wrapped yarn that is not provided with a positive false-twisting device disclosed in British Patent No. (GB-PS) 16 00 129, it is provided that the drawn sliver enters the hollow spindle at an angle of 3° to 10° with respect to the angle of rotation. By means of this rerouting, a false twist is produced in the sliver which, however, is not exactly defined. In addition, in the case of this type of construction, because of the lacking positive false-twisting device, the point is not exactly defined where the binding yarn winds around the sliver. Although, in the case of this known construction, the end of the hollow spindle is arranged to be very close to the nip of the pair of delivery rollers of the delivery device, whereby the distance between the end of the hollow spindle and the nip of the pair of delivery rollers is 25 mm and shorter than the staple length of the fiber material to be processed, no uniform wrapped yarn was spun in the case of this construction, as demonstrated in practice.

Preferably it is provided that the distance between the false-twisting device and the nip of the pair of delivery rollers is about 35 to 40 mm. Thus this distance is shorter than the staple of the sliver that is usually processed, but still long enough in order to possibly permit a swivelling of the hollow spindle past the pair of delivery rollers in order to interrupt the spindle drive. In this case, it is advantageous for the false-twisting device to project into the wedge-shaped gap formed by the pair of delivery rollers.

In a further development of the invention, it is provided that the false-twisting device is arranged at a short distance from the facing end of the sleeve carrying the binding yarn. In this case, it is preferably provided that the distance between the false-twisting device and the end of the sleeve carrying the binding yarn is about 10 to 15 mm. This development avoids the difficulty that, when the distance is too large, the binding yarn winds itself around the false twisting device during the withdrawal which may result not only in an impairment of the quality of the yarn but also in yarn breakage.

In a further development of the invention, it is provided that the binding yarn is wound into a cop on the sleeve, facing the false-twisting device with a slope which with respect to the axis of rotation has an angle of between 13° and 40° . The slope is selected corresponding to the binding yarn being used, where the angle is most often about 20° with respect to the axis of rotation.

In an advantageous development of the invention, it is provided that the length of the sleeve is about three times the maximum diameter of the cop. In this case, it is advantageous if the sleeve has a length of 180 to 200 mm and if the maximum diameter of the cop is about 60 to 80 mm. By limiting the sleeve to these lengths, the problem is avoided that the binding yarn, when being pulled off the lower winding half of the cop, receives an uncontrolled additional false twist. For the same reason, it is advantageous for the diamter to be limited since otherwise the binding yarn, when being withdrawn, may graze the cop in an uncontrollable manner.

In an advantageous development of the invention, it is provided that two cross holes are provided in the proximity of the intake of the hollow spindle, which holes are disposed diametrically opposite one another and are staggered in the longitudinal direction of the hollow spindle, where these cylindrical outer surface of the hollow spindle located between the cross holes has a diameter of about 8 to 10 mm. These cross holes serve as the false-twisting device. By means of this preferred dimensioning, an advantageous compromise is found between the guiding of the binding yarn in the case of cops with (only) small diameters and a not too extensive mass at the point of the spindle.

In another development, it is provided that the hollow spindle is surrounded by a housing that is open at both ends and extends at least over the range of the sleeve up to the false-twisting device. By means of such a housing, a reduction of noise and a protection of the binding thread from influences of the environment is achieved without disturbing the operation of the spinning aggregate for yarn wrapping. Since the pair of delivery rollers that is located very close to the false-twisting device projects almost into the housoing the sliver and the binding yarn can be introduced into the false twisting device largely without disturbances.

Further objects, features, and advantages of the present invention will become more apparent from the following description when taken with the accompanying drawings which show, for purposes of illustration only, an embodiment in accordance with the present invention.

BRIEF DESCRIPTION OF THE DRAWINGS

FIG. 2 is a sectional view along line II—II of FIG. 1; and

FIG. 3 is a vertical enlarged section through a false-twisting device constructed in accordance with a preferred embodiment of the present invention.

DETAILED DESCRIPTION OF THE DRAWINGS

Figure 1:
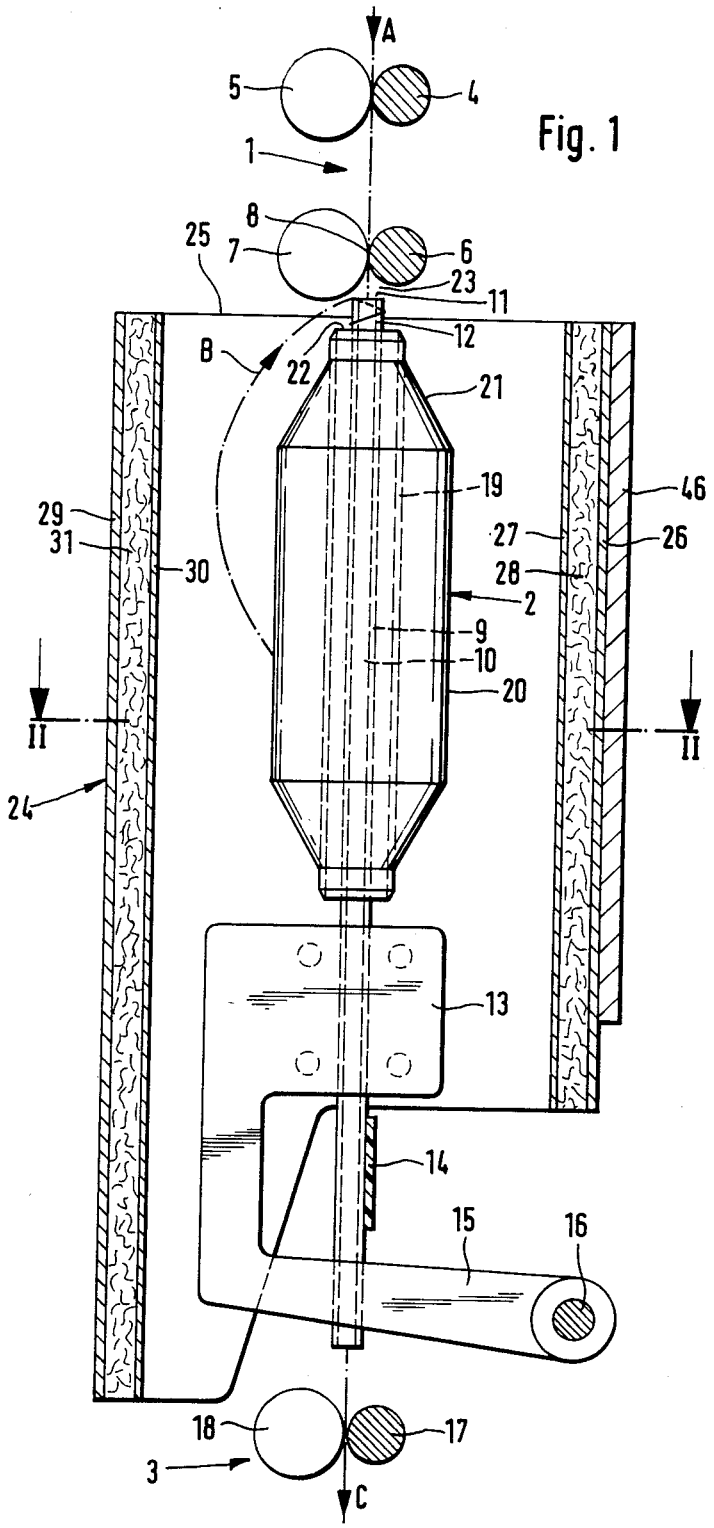
FIG. 1 is a vertical schematic sectional view through a spinning point of a spinning machine for wrapped yarn, constructed in accordance with a preferred embodiment of the invention.

A spinning machine for wrapped yarn includes a plurality of spinning aggregates a, b, c . . . that are arranged next to one another as schematically shown in FIG. 2. Each spinning aggregate has a delivery device 1 for a sliver A, a following twisting element 2 to which the sliver A and a binding yarn B are supplied, and a withdrawal device 3 for the spun wrapped yarn C.

The delivery device 1 has several pairs of rollers which are developed especially as an arrangement of drawing or drafting rollers. In FIG. 1, two pairs of rollers 4, 5 and 6, 7 of such an arrangement are shown, between which the sliver A is drawn, the last pair of rollers 6, 7 being the pair of delivery rollers of the delivery device 1. So-called lower rollers 4 and 6 are provided that are driven and extend over several spinning aggregates. The upper rollers 5 and 7, which are each preferably intended for only one spinning aggregate, are elastically pressed against these lower rollers 4 and 6. The pair of delivery rollers 6, 7 forms a nip 8 for the sliver A.

The twisting device 2 contains a hollow spindle 9, the shaft of which is provided with an axial through-borehole 10. The inlet 11 of the hollow spindle 9 is arranged directly behind the pair of delivery rollers 6, 7 of the delivery device 1 and in this area, has a positive false-twisting device 12, which is shown in FIG. 3 in an enlarged sectional view. The sliver A and the binding yarn B are introduced into the axial through-borehole 10 and shortly after the entrance, are rerouted toward the outside through a cross hole 32. Subsequently, the sliver A and the binding yarn B are reintroduced into the axial through-borehole 10 via an axially staggered cross hole 33 that is opposite the first cross hole 32 by 180°, said cross hole 33 having a larger diameter.

The hollow spindle 9 (FIG. 1) is disposed in a bearing housing 13 and at its area projecting from the other side of the bearing housing 13, is driven by means of a tangential belt 14 passing through the machine in longitudinal direction and being used for driving several or all hollow spindles on one side of the mahcine. The bearing housing 13 is arranged on a lever arm 15 that can be swivelled around a stationary shaft 16 extending in longitudinal direction of the machine, so that by means of the swivelling-away of the bearing housing 13, the hollow spindle 9 can be swivelled away from the driving belt 14 for interrupting the drive and for making the hollow spindle 9 accessible.

As the withdrawal mechanism 3, two withdrawal rollers 17 and 18 are provided, of which the withdrawal roller 17 is developed as a driven cylinder extending in longitudinal direction of the machine over several spinning points against which the withdrawal roller 18 is pressed that is developed as a pressure roller and is, in each case, assigned to only one spinning point. The withdrawal mechanism is followed by a wind-on mechanism that is not shown, by means of which the yarn C is wound on a spool.

A sleeve 19 is fitted onto the hollow spindle 9 and is firmly connected with it in respect to rotation, the binding yarn B being wound to form a cop 20 on said sleeve 19. Binding yarn B rotating with spindle 9 and withdrawn from the cop 20, via a balloon of yarn shown in dash lines in FIG. 1, approaches the inlet 11 of the hollow spindle 9. In the direction of the false-twisting device 12, the cop 20 has a slope 21 which preferably has an angle of between 13° and 40° with respect to the axis of rotation. The distance $d_1$ (FIG. 3) between the false-twising device 12 and the end 22 of the sleeve 19 carrying the binding yarn B is about 10 to 15 mm. The length of the sleeve 19 is from 180 to 200 mm. The maximal diameter of the wound cop 20 is about 60 to 80 mm.

The false-twisting device 12 is a separate component that is fastened by a threaded connection or the like at the end of the hollow spindle 9 facing the pair of delivery rollers 6, 7. The intake 11 of the false-twisting device 12 has a distance of about 35 mm to the wedge-shaped gap 8 of the pair of delivery rollers 6, 7. The first cross hole 32 follows about 5 mm after the intake 11. By means of these dimensions, a very short false twisting distance is maintained between the nip 8 of the pair of delivery rollers 6 and 7 and the false-twisting device 12, into which an exactly defined false twist is introduced which, because of the short length of the false-twisting distance, is distributed evenly in the sliver A. This makes it possible that the quality of the yarn C is significantly improved, especially with respect to uniformity.

As shown in FIG. 1, the intake 11 of the false-twisting device 12 projects into the wedge-shaped gap 23 of the pair of delivery rollers 6, 7.

As shown in FIGS. 1 and 2, the hollow spindles 9 of the individual spinning aggregates are each surrounded by a housing 24, that is open on both sides. In this case, the upper edge 25 of the housing 24 reaches into the area of the false-twising device 12. The other side, i.e., the side of the housing 24 directed to the operating side of the machine, extends over the bearing housing 13 of the hollow spindle 9 and over the area of the tangential belt 14 downward. Because of the short distance between the false-twisting device 12 and the pair of delivery rollers 6, 7 of the delivery device 1, the housing 24 is covered largely toward the top by the pair of delivery rollers 6, 7.

Transversely to the rotating direction of the hollow spindle 9, the housing 24 has a preferably square cross section with such dimensions that the binding yarn B withdrawn from the cop 20 and forming a balloon of yarn does not graze the inside walls of the housing.

The housings 24 of the spinning aggregates a, b and c are mounted at a bearing plate 46 extending in the longitudinal direction of the machine. The housings 24 are double-walled, for which purpose a meander-shaped bent plate section 26 extending in longitudinal direction of the machine is provided that forms the rear wall of the housing 24 and the side walls 38, 39 located between the spinning aggregates. At each spinning point, a U-shaped plate section 27 with its edges is fastened at the meander-shaped bent plate section 26, where, between the plate sections 26 and 27, a filling 28, 34, 35 of preferably plate-shaped noise-reducing material is arranged. The fastening of the U-shaped plate sections 27 preferably takes place by means of screws 36 and 37.

The front wall of the housing directed to the operating side of the machine is also formed with two plates 29 and 30 as a double wall. A noise-reducing plate 31 is arranged between the two plates 29 and 30. The plate 30 which is bent in the shape of a hat section and forms the inside wall is connected by the plate section by means of a hinge 43 having a vertical shaft. Hinge 43 has its hinge plate fastened at the meander-shaped bent plate section 26 by means of screws 44. The hinge 43 has a torsion spring that is not shown in detail, by means of which the housing wall developed as a door is held in the closed position in which the edge that is opposite the hinge 43 will rest against a preferably elastic stop 45 extending in parallel to the hinge 43.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A spinning aggregate for spinning sliver and binding yarn into a wrapped yarn comprising:

a drivable hollow spindle carrying a corotating sleeve with a binding yarn wound on said sleeve, a corotating positive false-twising device into which binding yarn and a sliver enter, a delivery mechanism having a pair of delivery rollers forming a nip for feeding said sliver, a pair of withdrawal rollers following the hollow spindle, wherein the distance between the false-twisting device and the nip of the pair of delivery rollers is shorter than the median staple length of the sliver.

2. A spinning aggregate according to claim 1, wherein the distance between the false-twisting device and the nip of the pair of delivery rollers is about 35 to 40 mm.

3. A spinning aggregate according to claim 1, wherein the false-twisting device projects into the wedge-shaped gap formed by the pair of delivery rollers.

4. A spinning aggregate according to claim 1, wherein the false-twisting device is arranged at a short distance from the facing end of the sleeve carrying the binding yarn.

5. A spinning aggregate according to claim 4, wherein the distance between the false-twisting device and the facing end of the sleeve carrying the binding yarn is about 10 to 15 mm.

6. A spinning aggregate according to claim 1, wherein the binding yarn on the sleeve is wound into a cop facing the false-twisting device, said cop tapering toward the false-twisting device with its slope having an angle of between 13° and 40° with respect to the axis of rotation of the sleeve.

7. A spinning aggregate according to claim 1, wherein the length of the sleeve is about three times the maximum diameter of the cop of binding yarn wound thereon.

8. A spinning aggregate according to claim 7, wherein the sleeve has a length of about 180 to 200 mm and wherein the maximum diameter of the cop of binding yarn wound thereon is about 60 to 80 mm.

9. A spinning aggregate according to claim 1, wherein the false-twisting device comprises two diametrically opposite longitudinally spaced cross holes in the proximity of the intake of the hollow spindle and wherein the cylindrical outer surface of the hollow spindle located between the cross holes has a diameter of about 8 to 10 mm.

10. A spinning aggregate according to claim 1, wherein the hollow spindle is surrounded by a housing that extends at least over the area of the sleeve up to the false-twisting device and is open at both ends.

11. A spinning aggregate according to claim 10, wherein the housing has an approximately square cross section transversely to the axis of the hollow spindle.

12. A spinning aggregate according to claim 10, wherein the housing is double-walled, and wherein a filling of a noise-reducing material is provided between the outer walls of the housing and the inner walls of the housing.

13. A spinning aggregate according to claim 10, wherein the outer walls of the housings of several housings arranged next to one another are formed by means of a continuous meander-shaped bent plate section forming the rear walls and the side walls and wherein a U-shaped plate section is provided from the respective inside wall of the housings, said U-shaped plate section being fastened at the meander-shaped plate section.

14. A spinning aggregate according to claim 10, wherein the front wall of the housing is developed as a door that can be opened up which is hingedly connected via a hinge to the meander-shaped plate section.

15. A spinning aggregate according to claim 2, the false-twisting device projects into the wedge-shaped formed by the pair of delivery rollers.

16. A spinning aggregate according to claim 5, wherein the distance between the false-twisting device and the nip of the pair of delivery rollers is about 35 to 40 mm.

17. A spinning aggregate according to claim 16, wherein the binding yarn on the sleeve is wound into a cop facing the false-twisting device, said cop tapering toward the false-twisting device with its slope having an angle of between 13° and 40° with regard to the axis of rotation of the sleeve.

18. A spinning aggregate according to claim 17, wherein the length of the sleeve is about three times the maximum diameter of the cop of binding yarn wound thereon.

19. A spinning aggregate according to claim 18, wherein the hollow spindle is surrounded by a housing that extends at least over the area of the sleeve up to the false-twisting device and is open at both ends.

20. A spinning aggregate according to claim 19, wherein the outer walls of the housings of several housings arranged next to one another are formed by means of a continuous meander-shaped bent plate section forming the rear walls and the side walls and wherein a U-shaped plate section is provided from the respective inside wall of the housings, said U-shaped plate section being fastened at the meander-shaped plate section.

* * * * *